US008715826B2

(12) United States Patent
Mackey et al.

(10) Patent No.: US 8,715,826 B2
(45) **Date of Patent: *May 6, 2014**

(54) STRUCTURES COMPRISING AN ASSOCIATION AGENT AND PROCESSES FOR MAKING SAME

(71) Applicant: The Procter & Gamble Company, Cincinatti, OH (US)

(72) Inventors: Larry Neil Mackey, Fairfield, OH (US); Gregory Charles Gordon, Miami Township, OH (US); Stephen Wayne Heinzman, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/688,783

(22) Filed: Nov. 29, 2012

(65) Prior Publication Data

US 2013/0089732 A1 Apr. 11, 2013

Related U.S. Application Data

(63) Continuation of application No. 13/417,537, filed on Mar. 12, 2012, now Pat. No. 8,343,625, which is a continuation of application No. 11/295,939, filed on Dec. 7, 2005, now Pat. No. 8,273,453, which is a continuation of application No. 11/018,746, filed on Dec. 20, 2004, now abandoned.

(51) Int. Cl.
*D02G 3/02* (2006.01)

(52) U.S. Cl.
USPC ..... 428/364; 428/375; 428/393; 428/394; 8/115.51; 8/115.6

(58) Field of Classification Search
None
See application file for complete search history.

(56) References Cited

U.S. PATENT DOCUMENTS

| | | | | |
|---|---|---|---|---|
| 3,066,107 | A | 11/1962 | Fukushima et al. | |
| 3,093,534 | A | 6/1963 | Filling | |
| 3,442,692 | A * | 5/1969 | Gaiser | 427/240 |
| 3,636,952 | A | 1/1972 | George | |
| 4,523,002 | A | 6/1985 | Campbell et al. | |
| 4,525,567 | A | 6/1985 | Campbell et al. | |
| 5,242,433 | A * | 9/1993 | Smith et al. | 604/289 |
| 5,965,651 | A | 10/1999 | Ishii et al. | |

(Continued)

FOREIGN PATENT DOCUMENTS

| | | | |
|---|---|---|---|
| EP | 1 132 427 | A1 | 9/2001 |
| EP | 1 035 239 | B1 | 5/2005 |
| WO | WO 03/066942 | A1 | 8/2003 |
| WO | WO 2004/108832 | A2 | 12/2004 |

OTHER PUBLICATIONS

Zheng et al., Preparation and Characterization of Chitosan/Poly(vinyl alcohol) Blend Fibers, Journal of Applied Polymer Science, vol. 80, 2558-2565, pp. 2558-2565.*
All Office Actions in U.S. Appl. No. 13/417,537.

(Continued)

*Primary Examiner* — David Sample
*Assistant Examiner* — Nicole T Gugliotta
(74) *Attorney, Agent, or Firm* — C. Brant Cook

(57) ABSTRACT

Polysaccharides and/or hydroxyl polymers, more particularly, structures, especially fibers, comprising a polysaccharide and/or hydroxyl polymer and an association agent, fibrous structures comprising such structures and processes for making such structures and/or fibrous structures are provided.

10 Claims, 4 Drawing Sheets

(56) References Cited

U.S. PATENT DOCUMENTS

| | | | | |
|---|---|---|---|---|
| 5,997,791 | A * | 12/1999 | Chou et al. | 264/210.8 |
| 6,372,387 | B1 | 4/2002 | Kawakami et al. | |
| 6,593,408 | B1 | 7/2003 | Takaki et al. | |
| 6,709,526 | B1 | 3/2004 | Bailey et al. | |
| 6,723,160 | B2 | 4/2004 | Mackey et al. | |
| 6,802,895 | B2 | 10/2004 | Mackey et al. | |
| 6,811,740 | B2 | 11/2004 | James et al. | |
| 6,923,996 | B2 | 8/2005 | Epstein et al. | |
| 6,955,850 | B1 | 10/2005 | Cabell et al. | |
| 7,390,565 | B2 | 6/2008 | Mackey et al. | |
| 7,491,443 | B2 | 2/2009 | Mackey et al. | |
| 8,273,453 | B2 * | 9/2012 | Mackey et al. | 428/364 |
| 8,343,625 | B2 * | 1/2013 | Mackey et al. | 428/364 |
| 2003/0100240 | A1 | 5/2003 | Takai et al. | |
| 2003/0201579 | A1 | 10/2003 | Gordon et al. | |
| 2003/0203196 | A1 | 10/2003 | Trokhan et al. | |
| 2004/0052746 | A1 | 3/2004 | Tamareselvy et al. | |
| 2004/0132873 | A1 * | 7/2004 | Bailey et al. | 524/47 |
| 2004/0249066 | A1 | 12/2004 | Heinzman et al. | |
| 2005/0076809 | A1 | 4/2005 | Mackey et al. | |
| 2005/0136253 | A1 | 6/2005 | Michael et al. | |
| 2005/0137225 | A1 * | 6/2005 | Kohn et al. | 514/304 |
| 2005/0137330 | A1 | 6/2005 | Forshey et al. | |
| 2005/0137331 | A1 | 6/2005 | Forshey et al. | |
| 2006/0134410 | A1 | 6/2006 | Mackey et al. | |
| 2012/0196124 | A1 | 8/2012 | Mackey et al. | |

OTHER PUBLICATIONS

MiniFibers, Inc., "Choosing the Proper Short Cut Fiber for Your Web", (no date available).

* cited by examiner

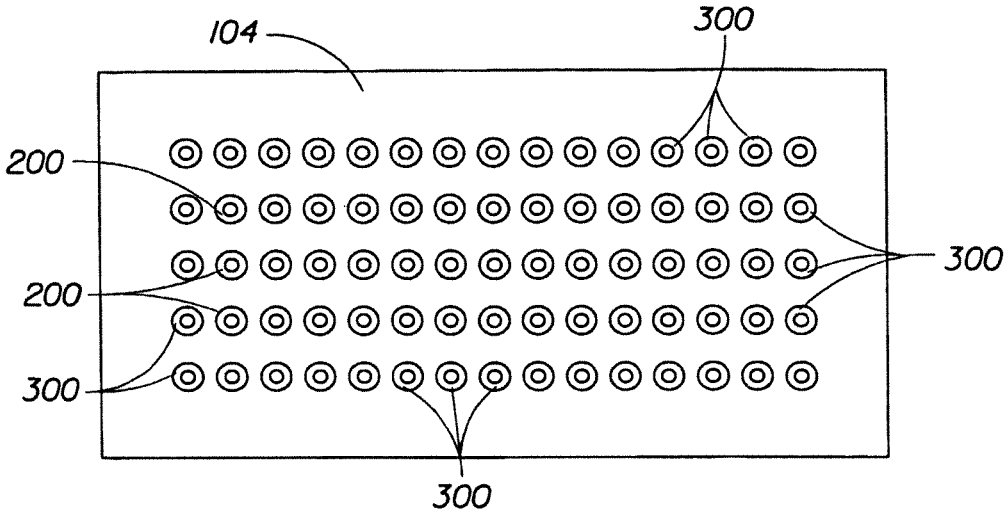
Fig. 5
Fig. 6
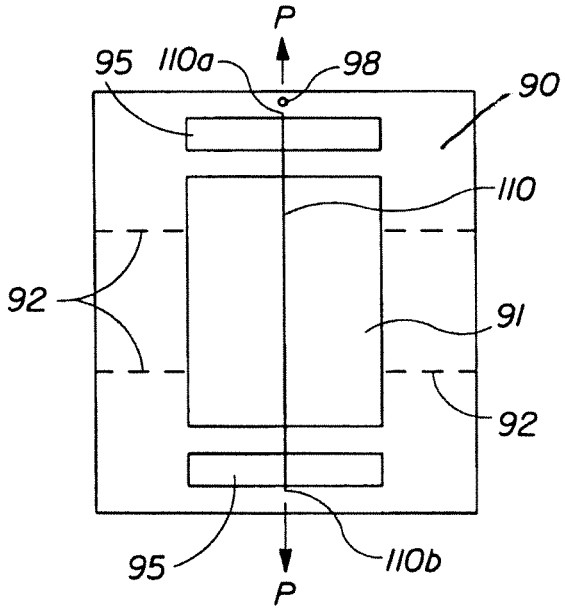

STRUCTURES COMPRISING AN ASSOCIATION AGENT AND PROCESSES FOR MAKING SAME

FIELD OF THE INVENTION

The present invention relates to polysaccharides and/or hydroxyl polymers, more particularly, to structures, especially fibers, comprising a polysaccharide and/or hydroxyl polymer and an association agent, fibrous structures comprising such structures and processes for making such structures and/or fibrous structures.

BACKGROUND OF THE INVENTION

Structures, such as fibers and/or films, comprising polysaccharides and/or hydroxyl polymers are known in the art. However, structures, especially in the form of fibers, comprising polysaccharides and/or hydroxyl polymers and an association agent wherein the structures exhibit an apparent peak wet tensile stress greater than 0.2 MPa and/or an average fiber diameter of less than 10 μm have been until now unobtainable.

Accordingly, there exists a need for structures that comprise a polysaccharide and/or hydroxyl polymer and an association agent wherein the structures exhibit an apparent peak wet tensile stress greater than 0.2 MPa and/or an average fiber diameter of less than 10 μm, webs comprising such structures and processes for making such structures.

SUMMARY OF THE INVENTION

The present invention fulfills the needs described above by providing structures comprising a polysaccharide and/or hydroxyl polymer and an association agent and/or webs comprising such structures and processes for making such structures and/or webs.

In one example of the present invention, a non-naturally occurring structure in the form of a fiber, wherein the fiber comprises a polysaccharide and/or hydroxyl polymer and an association agent, is provided.

In another example of the present invention, a non-naturally occurring structure comprising a polysaccharide and/or hydroxyl polymer and an association agent wherein the structure exhibits an apparent peak wet tensile stress greater than 0.2 MPa is provided.

In another example of the present invention, a fiber comprising a polysaccharide and/or hydroxyl polymer and an association agent wherein the fiber exhibits an average fiber diameter of less than 10 μm is provided.

In another example of the present invention, a web comprising a structure according to the present invention is provided.

In still another example of the present invention, a fibrous structure comprising one or more non-naturally occurring fibers comprising a polysaccharide and/or hydroxyl polymer and an association agent.

In yet another example of the present invention, a process for making a structure comprising a polysaccharide and/or hydroxyl polymer and an association agent, wherein the process comprises the step of polymer processing a polysaccharide and/or hydroxyl polymer-containing composition comprising an association agent into a structure comprising a polysaccharide and/or hydroxyl polymer and an association agent, is provided.

In even yet another example of the present invention, a process for making a structure comprising a polysaccharide and/or hydroxyl polymer and an association agent, wherein the process comprises the steps of:

a. providing a polysaccharide and/or hydroxyl polymer-containing composition comprising an association agent; and b. polymer processing the polysaccharide and/or hydroxyl polymer-containing composition into a structure comprising the polysaccharide and/or hydroxyl polymer and the association agent, is provided.

Accordingly, the present invention provides a structure comprising a polysaccharide and/or hydroxyl polymer and an association agent, a web comprising such a structure and a process for making such a structure and/or web.

BRIEF DESCRIPTION OF THE DRAWINGS

FIG. 5 is a view similar to that of FIG. 4 and showing one possible arrangement of orifices for providing a boundary air around the attenuation zone.

FIG. 6 is a schematic plan view of a coupon that can be used for determining apparent peak wet tensile stress of fibers according to the present invention.

DETAILED DESCRIPTION OF THE INVENTION

Definitions

Figure 1A:
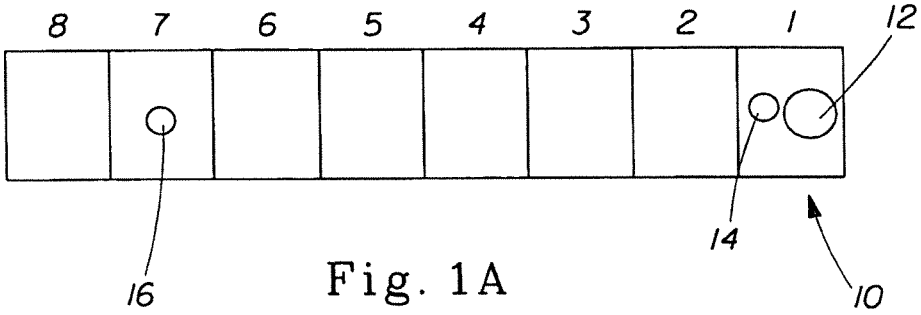
FIG. 1A is a schematic side view of a barrel of a twin screw extruder suitable for use in the present invention.

"Structure" as used herein means any physical structure formed as a result of processing a polysaccharide and/or hydroxyl polymer-containing composition in accordance with the present invention. Nonlimiting examples of structures in accordance with the present invention include fibers, films and/or foams. The structures of the present invention are non-naturally occurring physical structures. In other words, they are man-made physical structures.

"Fiber" or "filament" as used herein means a slender, thin, and highly flexible object having a major axis which is very long, compared to the fiber's two mutually-orthogonal axes that are perpendicular to the major axis. A fiber may exhibit an aspect ratio of the major's axis length to an equivalent diameter of the fiber's cross-section perpendicular to the major axis greater than 100/1, more specifically greater than 500/1, and still more specifically greater than 1000/1, and even more specifically, greater than 5000/1. The fibers may be continuous or substantially continuous fibers or they may be discontinuous fibers.

The fibers of the present invention comprise a polysaccharide and/or hydroxyl polymer and an association agent and may have an average fiber diameter of less than about 50 μm and/or less than about 20 μm and/or less than about 10 μm and/or less than about 8 μm and/or less than about 6 μm and/or less than about 4 μm as measured by the Average Fiber Diameter Test Method described herein. Such a fiber may exhibit an average fiber diameter of greater than about 1 μm and/or greater than about 2 μm and/or greater than about 3 μm.

The fibers of the present invention may include melt blown fibers, dry spun fibers, rotary spun fibers, spunbond fibers, staple fibers, hollow fibers, shaped fibers, such as multi-lobal fibers and multicomponent fibers, especially bicomponent fibers. The multicomponent fibers, especially bicomponent fibers, may be in a side-by-side, sheath-core, segmented pie, ribbon, islands-in-the-sea configuration, or any combination thereof. The sheath may be continuous or non-continuous around the core. The ratio of the weight of the sheath to the core can be from about 5:95 to about 95:5. The fibers of the present invention may have different geometries that include round, elliptical, star shaped, rectangular, and other various eccentricities.

In another example, the structures of the present invention may include a multiconstituent structure, such as a multicomponent fiber, comprising a polysaccharide and/or hydroxyl polymer and an association agent of the present invention along with another polymer. A multicomponent fiber, as used herein, means a fiber having more than one separate part in spatial relationship to one another. Multicomponent fibers include bicomponent fibers, which is defined as a fiber having two separate parts in a spatial relationship to one another. The different components of multicomponent fibers can be arranged in substantially distinct regions across the cross-section of the fiber and extend continuously along the length of the fiber.

A nonlimiting example of such a multicomponent fiber, specifically a bicomponent fiber, is a bicomponent fiber in which the hydroxyl polymer of the present invention represents the core of the fiber and another polymer represents the sheath, which surrounds or substantially surrounds the core of the fiber. The hydroxyl polymer-containing composition from which such a structure is derived may include both the hydroxyl polymer and the other polymer.

In another multicomponent, especially bicomponent fiber embodiment, the sheath may comprise a hydroxyl polymer and a crosslinking system having a crosslinking agent, and the core may comprise a hydroxyl polymer and a crosslinking system having a crosslinking agent. With respect to the sheath and core, the hydroxyl polymer may be the same or different and the crosslinking agent may be the same or different. Further, the level of hydroxyl polymer may be the same or different and the level of crosslinking agent may be the same or different.

One or more structures of the present invention may be incorporated into a multi-structure product, such as a fibrous structure and/or web, if the structures are in the form of fibers. Such a multi-structure product may ultimately be incorporated into a commercial product, such as a single- or multi-ply sanitary tissue product, such as facial tissue, bath tissue, paper towels and/or wipes, feminine care products, diapers, writing papers, cores, such as tissue cores, and other types of paper products.

A "fibrous structure" as used herein means a single web structure that comprises at least one fiber. For example, a fibrous structure of the present invention may comprise one or more fibers, wherein at least one of the fibers comprises a polysaccharide and/or hydroxyl polymer fiber. In another example, a fibrous structure of the present invention may comprise a plurality of fibers, wherein at least one (sometimes a majority, even all) of the fibers comprises a polysaccharide and/or hydroxyl polymer fiber. The fibrous structures of the present invention may be layered such that one layer of the fibrous structure may comprise a different composition of fibers and/or materials from another layer of the same fibrous structure. "Web" as used herein means a physical structure that comprises at least one planar surface. In another example, a web is a physical structure that comprises two planar surfaces. A web may be a film, if no fibers are present within the web. A web that comprises one or more fibers may be a fibrous structure.

One or more polysaccharide and/or hydroxyl polymer fibers of the present invention may be associated together to form a web. Typically, numerous fibers are collected, such as on a forming wire and/or belt and/or three dimensional molding member, in order to the association of the fibers into a web.

In one example of the present invention, a web and/or fibrous structure of the present invention exhibits an initial total wet tensile of greater than about 10 g/2.54 cm (10 g/in).

"Hydroxyl polymer" as used herein means any polymer that contains greater than 10% and/or greater than 20% and/or greater than 25% by weight hydroxyl groups.

"Hydroxyl polymer-containing composition" as used herein means a composition that comprises a hydroxyl polymer (substituted or unsubstituted).

"Unsubstituted hydroxyl polymer" and/or "unsubstituted form of a hydroxyl polymer" and/or "unsubstituted form of a substituted hydroxyl polymer" as used herein means a hydroxyl polymer in which all of its original hydroxyl moieties are intact. In other words, no derivatized hydroxyl moieties exist in the hydroxyl polymer. For example, a hydroxyethyl starch is not an unsubstituted hydroxyl polymer. The mere removal of the hydrogen from the oxygen in the hydroxyl moieties does not create a substituted hydroxyl polymer.

"Substituted hydroxyl polymer" and/or "substituted form of a hydroxyl polymer" and/or "substituted form of an unsubstituted hydroxyl polymer" as used herein means a hydroxyl polymer comprising at least one derivative of an original hydroxyl moiety. In other words, at least one oxygen originally present in a hydroxyl moiety is covalently bonded to a moiety other than hydrogen.

"Association agent" as used herein means an agent that is capable of interacting with a hydroxyl polymer to influence the hydroxyl polymer-containing composition's properties, especially the hydroxyl polymer-containing composition's spinning (rheological) properties, without covalently binding to the hydroxyl polymer.

"Non-naturally occurring" as used herein with respect to "non-naturally occurring fiber" means that the fiber is not found in nature in that form. In other words, some chemical processing of materials needs to occur in order to obtain the non-naturally occurring fiber. For example, a wood pulp fiber is a naturally occurring fiber, however, if the wood pulp fiber is chemically processed, such as via a lyocell-type process, a solution of cellulose is formed. The solution of cellulose may then be spun into a fiber. Accordingly, this spun fiber would be considered to be a non-naturally occurring fiber since it is not directly obtainable from nature in its present form.

"Naturally occurring" as used herein means that a fiber and/or a material is found in nature in its present form. An example of a naturally occurring fiber is a wood pulp fiber.

"Apparent Peak Wet Tensile Stress," or simply "Wet Tensile Stress," is a condition existing within a structure, such as a fiber, at the point of its maximum (i.e., "peak") stress as a result of strain by external forces, and more specifically elongation forces, as described in the Apparent Peak Wet Tensile Stress Test Method described herein below. The stress is "apparent" because a change, if any, in the structures average thickness, such as a fiber's average fiber diameter, resulting from the structure's elongation, is not taken into consideration for the purposes of determining the apparent peak wet tensile stress of a structure. The apparent peak wet tensile stress of the structures is proportional to their wet tensile strength and is used herein to quantitatively estimate the latter.

"Weight average molecular weight" as used herein means the weight average molecular weight as determined using gel permeation chromatography according to the protocol found in Colloids and Surfaces A. Physico Chemical & Engineering Aspects, Vol. 162, 2000, pg. 107-121.

"Polymer" as used herein means one or more, often repeating molecular units that are covalently bound together via a C—C bond. Polymers generally include, but are not limited to, homopolymers, copolymers, such as for example, block, graft, random and alternating copolymers, terpolymers, etc., and blends and modifications thereof. In addition, unless otherwise specifically limited, the term "polymer" includes all possible geometric configurations of the material. The configurations include, but are not limited to, isotactic, atactic, syndiotactic, and random symmetries.

"Spinning process temperature" as used herein means the temperature at which the hydroxyl polymer structures in the form of fibers are attenuated at the external surface of the spinning die as the hydroxyl polymer structures are formed.

Fibers

The fibers of the present invention comprising a polysaccharide and/or hydroxyl polymer and an association agent may be continuous or substantially continuous. In one example, a fiber is continuous if it exhibits a length greater than about 2.54 cm (1 inch) and/or greater than 5.08 cm (2 inches).

The fibers of the present invention a polysaccharide and/or hydroxyl polymer and an association agent may be produced by crosslinking two or more hydroxyl polymers together. Nonlimiting examples of a suitable crosslinking system for achieving crosslinking of the polysaccharide and/or hydroxyl polymer comprises a crosslinking agent and optionally a crosslinking facilitator, wherein the polysaccharide and/or hydroxyl polymer is crosslinked by the crosslinking agent. An example of a suitable crosslinking system for use in the present invention is described in U.S. Patent Application Publication 2004/0249066.

In one example, the fiber of the present invention a polysaccharide and/or hydroxyl polymer and an association agent, as a whole, exhibits no melting point. In other words, it degrades before melting.

In addition to the fibers of the present invention a polysaccharide and/or hydroxyl polymer and an association agent, other fibers may be included in the webs of the present invention. For example, the webs may include pulp fibers, such as cellulose fibers and/or other polymer fibers besides the hydroxyl polymer fibers.

In one example of the present invention, a fiber of the present invention a polysaccharide and/or hydroxyl polymer and an association agent exhibits an apparent peak wet tensile stress greater than 0.2 MPa and/or greater than 0.5 MPa and/or greater than 1 MPa and/or In another example of the present invention, a fiber of the present invention a polysaccharide and/or hydroxyl polymer and an association agent comprises at least about 50% and/or at least about 60% and/or at least about 70% to about 100% and/or to about 95% and/or to about 90% by weight of the fiber of a hydroxyl polymer.

In another example of the present invention, a fiber of the present invention a polysaccharide and/or hydroxyl polymer and an association agent exhibits a pH of less than about 7 and/or less than about 6 and/or less than about 5 and/or less than about 4.5 and/or less than about 4.

In another example of the present invention, a fiber of the present invention comprises a polysaccharide and/or hydroxyl polymer and an association agent. The association agent may be separate and discrete from the polysaccharide and/or hydroxyl polymer. In other words, the association agent may not be covalently bound to an oxygen atom of a hydroxyl moiety of the polysaccharide and/or hydroxyl polymer unless that oxygen atom forms part of a crosslink.

Polysaccharides

Polysaccharides in accordance with the present invention include any unsubstituted hydroxyl-containing polysaccharides, for example, native dent corn starch and/or acid-thinned dent corn starch and/or any substituted hydroxyl-containing polysaccharides, for example, hydroxyethyl starch.

In one example, the polysaccharide of the present invention includes greater than 10% and/or greater than 20% and/or greater than 25% by weight hydroxyl moieties.

Nonlimiting examples of polysaccharides in accordance with the present invention include starch, starch derivatives, starch copolymers, chitosan, chitosan derivatives, chitosan copolymers, cellulose, cellulose derivatives such as cellulose ether and ester derivatives, cellulose copolymers, gums, arabinans, galactans and various other polysaccharides and mixtures thereof.

The polysaccharides of the present invention may have a weight average molecular weight of greater than about 10,000 g/mol and/or greater than about 40,000 g/mol and/or from about 10,000 to about 80,000,000 g/mol and/or from about 10,000 to about 40,000,000 g/mol and/or from about 10,000 to about 10,000,000 g/mol. Higher and lower molecular weight hydroxyl polymers may be used in combination.

Well known modifications of polysaccharides, for example natural starches, include chemical modifications and/or enzymatic modifications. For example, a natural starch can be acid-thinned, hydroxy-ethylated, hydroxy-propylated, and/or oxidized.

In one example, the polysaccharide comprises starch. The starch may be acid thinned starch and/or alkaline cooked starch. The starch may be derived from corn, potato, wheat, tapioca and the like. The weight ratio of amylose to amylopectin in the starch may be from about 10:90 to about 99:1 respectively. In one example, the starch comprises from at least about 10% and/or at least about 20% to about 99% and/or to about 90% by weight of amylose.

Hydroxyl Polymers

Hydroxyl Polymers may be used alone or in combination with the polysaccharides of the present invention to form the structures of the present invention. The hydroxyl polymers may be unsubstituted or substituted.

Nonlimiting examples of suitable hydroxyl polymers include polyvinylalcohols characterized by the following general formula:

Structure I

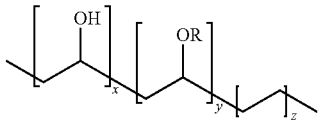

each R is selected from the group consisting of $C_1$-$C_4$ alkyl; $C_1$-$C_4$ acyl; and x/x+y+z=0.5–1.0. In one example, the polyvinylalcohol has no "y" and/or "z" units.

Polyvinyl alcohols herein can be grafted with other monomers to modify its properties. A wide range of monomers has been successfully grafted to polyvinyl alcohol. Nonlimiting examples of such monomers include vinyl acetate, styrene, acrylamide, acrylic acid, 2-hydroxyethyl methacrylate, acrylonitrile, 1,3-butadiene, methyl methacrylate, methacrylic acid, vinylidene chloride, vinyl chloride, vinyl amine and a variety of acrylate esters.

Association Agents

The polysaccharide and/or hydroxyl polymer-containing compositions of the present invention may contain an association agent. The association agent is capable of associating, typically other than by covalent bond, with the polysaccharide and/or hydroxyl polymer, particularly the hydroxyl moieties thereof.

In one example, the association agent is a cationic agent. The cationic agent may be selected from the group consisting of: quaternary ammonium compounds, quaternary alkyl amines, quaternary aryl amines, imidizolinium quats, polyethoxylated quaternary alkyl amines and mixture thereof.

Nonlimiting examples of suitable association agents include quaternary ammonium compounds, amine oxides and amines.

Nonlimiting examples of quaternary ammonium compounds include dodecyltrimethylammonium chloride, stearyltrimethylammonium chloride, stearyldimethylbenzylammonium chloride, didodecyldimethylammonium chloride, tetraethylammonium chloride, polyethoxylated quaternary ammonium chloride such as Ethoquad C/12 from Akzo Nobel Chemicals Inc. A suitable quaternary ammonium compound is commercially available from Akzo Nobel Chemicals Inc. under the tradename Arquad 12-50.

Nonlimiting examples of amine oxides include cetyldimethylamine oxide, lauryldimethylamine oxide, cocamidopropylamine oxide. A suitable amine oxide is commercially available from Stepan Company under the tradename Ammonyl CO.

Nonlimiting examples of amines, such as alkyl amines, include ethoxylated dodecylamine, ethoxylated stearylamine, and ethoxylated oleylamine. A suitable amine is commercially available from Akzo Nobel Chemicals Inc. under the tradename Ethomeen C/12.

The association agent may be present in the structure, such as the fiber, at a level from greater than 0% to less than about 100%. In one example, the association agent is present in the structure at a level of from greater than 0% and/or from at least about 0.001% and/or at least about 0.01% and/or at least about 0.1% and/or at least about 1% to about 50% and/or to about 40% and/or to about 30% and/or to about 15% and/or to about 10% and/or to about 5% and/or to about 3%.

Polysaccharide and/or Hydroxyl Polymer-Containing Composition

The polysaccharide and/or hydroxyl polymer-containing composition of the present invention comprises a polysaccharide and/or hydroxyl polymer. The polysaccharide-containing composition may be a mixture of polysaccharides and/or hydroxyl polymers and optionally other polymers, wherein at least one is a polysaccharide and/or hydroxyl polymer, and/or fillers both inorganic and organic, and/or fibers and/or foaming agents.

The composition may already be formed. In one example, an unsubstituted polysaccharide may be solubilized via contact with a liquid, such as water, in order to form an unsubstituted polysaccharide-containing composition. Such a liquid may be considered for the purposes of the present invention as performing the function of an external plasticizer. Alternatively, any other suitable processes known to those skilled in the art to produce the polysaccharide-containing composition such that the polysaccharide-containing composition exhibits suitable properties for processing the composition into a structure in accordance with the present invention may be used.

The composition may have and/or be exposed to a temperature of from about 23° C. to about 100° C. and/or from about 65° C. to about 95° C. and/or from about 70° C. to about 90° C. when making structures from the composition. The composition may have and/or be exposed to a temperature that is generally higher when making film and/or foam structures, as described below.

The pH of the composition may be from about 2.5 to about 10 and/or from about 3 to about 9.5 and/or from about 3 to about 8.5 and/or from about 3.2 to about 8 and/or from about 3.2 to about 7.5.

In another example, a polysaccharide-containing composition of the present invention may comprise at least about 5% and/or at least about 15% and/or from at least about 20% and/or 30% and/or 40% and/or 45% and/or 50% to about 75% and/or 80% and/or 85% and/or 90% and/or 95% and/or 99.5% by weight of the polysaccharide-containing composition of a substituted or unsubstituted polysaccharide.

The polysaccharide and/or hydroxyl polymer may have a weight average molecular weight greater than about 10,000 g/mol prior to crosslinking.

A crosslinking system may be present in the composition and/or may be added to the composition before processing the composition into a structure.

The composition may comprise a) at least about 5% and/or at least about 15% and/or from at least about 20% and/or 30% and/or 40% and/or 45% and/or 50% to about 75% and/or 80% and/or 85% by weight of the composition of a polysaccharide and/or hydroxyl polymer; b) a crosslinking system comprising from about 0.1% to about 10% by weight of the composition of a crosslinking agent; and c) from about 10% and/or 15% and/or 20% to about 50% and/or 55% and/or 60% and/or 70% by weight of the composition of external plasticizer e.g., water.

The crosslinking system of the present invention may further comprise, in addition to the crosslinking agent, a crosslinking facilitator.

"Crosslinking facilitator" as used herein means any material that is capable of activating a crosslinking agent thereby transforming the crosslinking agent from its unactivated state to its activated state.

Upon crosslinking the polysaccharide, the crosslinking agent becomes an integral part of the polysaccharide structure as a result of crosslinking the polysaccharide as shown in the following schematic representation:

Polysaccharide-Crosslinking agent-Polysaccharide

The crosslinking of hydroxyl polymers together is similar. The same is true for the crosslinking of a polysaccharide and a hydroxyl polymer.

The crosslinking facilitator may include derivatives of the material that may exist after the transformation/activation of the crosslinking agent. For example, a crosslinking facilitator salt being chemically changed to its acid form and vice versa.

Nonlimiting examples of suitable crosslinking facilitators include acids having a pKa of between 2 and 6 or salts thereof. The crosslinking facilitators may be Bronsted Acids and/or salts thereof, for example ammonium salts thereof.

In addition, metal salts, such as magnesium and zinc salts, can be used alone or in combination with Bronsted Acids and/or salts thereof, as crosslinking facilitators.

Nonlimiting examples of suitable crosslinking facilitators include acetic acid, benzoic acid, citric acid, formic acid, glycolic acid, lactic acid, maleic acid, phthalic acid, phosphoric acid, succinic acid and mixtures thereof and/or their salts, such as their ammonium salts, such as ammonium glycolate, ammonium citrate, ammonium sulfate, and ammonium chloride.

Other Polymers

Polymers other than hydroxyl polymers may be included in the structures of the present invention. Nonlimiting examples of suitable polymers include petroleum-derived polymers and polyvinylamines.

"Petroleum-derived polymers" as used herein means any polymer that has been obtained from petroleum. Nonlimiting examples of such petroleum-derived polymers include polyolefins. Nonlimiting examples of polyolefins include polypropylene, polyethylene, polyesters, and the like.

"Polyvinylamines" as used herein means any hydrocarbon polymer that comprises amino groups.

Synthesis of Polysaccharide and/or Hydroxyl Polymer-Containing Composition

A polysaccharide and/or hydroxyl polymer-containing composition of the present invention may be prepared using a screw extruder, such as a vented twin screw extruder.

A barrel 10 of an APV Baker (Peterborough, England) twin screw extruder is schematically illustrated in FIG. 1A. The barrel 10 is separated into eight zones, identified as zones 1-8. The barrel 10 encloses the extrusion screw and mixing elements, schematically shown in FIG. 1B, and serves as a containment vessel during the extrusion process. A solid feed port 12 is disposed in zone 1 and a liquid feed port 14 is disposed in zone 1. A vent 16 is included in zone 7 for cooling and decreasing the liquid, such as water, content of the mixture prior to exiting the extruder. An optional vent stuffer, commercially available from APV Baker, can be employed to prevent the polysaccharide and/or hydroxyl polymer-containing composition from exiting through the vent 16. The flow of the polysaccharide and/or hydroxyl polymer-containing composition through the barrel 10 is from zone 1 exiting the barrel 10 at zone 8.

Figure 1B:
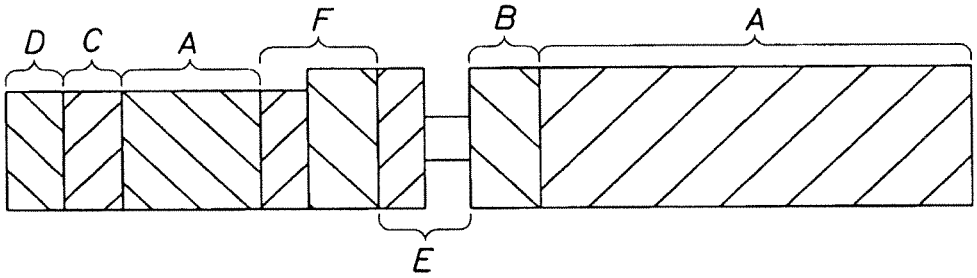
FIG. 1B is a schematic side view of a screw and mixing element configuration suitable for use in the barrel of FIG. 1A.

A screw and mixing element configuration for the twin screw extruder is schematically illustrated in FIG. 1B. The twin screw extruder comprises a plurality of twin lead screws (TLS) (designated A and B) and single lead screws (SLS) (designated C and D) installed in series. Screw elements (A-D) are characterized by the number of continuous leads and the pitch of these leads.

A lead is a flight (at a given helix angle) that wraps the core of the screw element. The number of leads indicates the number of flights wrapping the core at any given location along the length of the screw. Increasing the number of leads reduces the volumetric capacity of the screw and increases the pressure generating capability of the screw.

The pitch of the screw is the distance needed for a flight to complete one revolution of the core. It is expressed as the number of screw element diameters per one complete revolution of a flight. Decreasing the pitch of the screw increases the pressure generated by the screw and decreases the volumetric capacity of the screw.

The length of a screw element is reported as the ratio of length of the element divided by the diameter of the element.

This example uses TLS and SLS. Screw element A is a TLS with a 1.0 pitch and a 1.5 length ratio. Screw element B is a TLS with a 1.0 pitch and a 1.0 L/D ratio. Screw element C is a SLS with a ¼ pitch and a 1.0 length ratio. Screw element D is a SLS and a ¼ pitch and a ½ length ratio.

Bilobal paddles, E, serving as mixing elements, are also included in series with the SLS and TLS screw elements in order to enhance mixing. Various configurations of bilobal paddles and reversing elements F, single and twin lead screws threaded in the opposite direction, are used in order to control flow and corresponding mixing time.

In zone 1, a substituted or unsubstituted polysaccharide, so long as at least one hydroxyl moiety is intact, is fed into the solid feed port at a rate of 230 grams/minute using a K-Tron (Pitman, N.J.) loss-in-weight feeder. This polysaccharide is combined inside the extruder (zone 1) with water, an external plasticizer, added at the liquid feed at a rate of 146 grams/minute using a Milton Roy (Ivyland, Pa.) diaphragm pump (1.9 gallon per hour pump head) to form a polysaccharide/water slurry. This slurry is then conveyed down the barrel of the extruder and cooked, in the presence of an alkaline agent, such as ammonium hydroxide and/or sodium hydroxide. The cooking causes a hydrogen from at least one hydroxyl moiety on the polysaccharide to become disassociated with the hydroxyl moiety and thus create a negative charge on the oxygen atom of the former hydroxyl moiety. This oxygen atom is now open for association by an association agent, such as a quaternary ammonium compound, for example a quaternary amine. Accordingly, an association agent is added to the polysaccharide mixture, thus creating an associated polysaccharide.

Table 1 describes the temperature, pressure, and corresponding function of each zone of the extruder.

TABLE I

| Zone | Temp. (° F.) | Pressure | Description of Screw | Purpose |
|---|---|---|---|---|
| 1 | 70 | Low | Feeding/Conveying | Feeding and Mixing |
| 2 | 70 | Low | Conveying | Mixing and Conveying |
| 3 | 70 | Low | Conveying | Mixing and Conveying |
| 4 | 130 | Low | Pressure/Decreased Conveying | Conveying and Heating |
| 5 | 300 | Medium | Pressure Generating | Cooking at Pressure and Temperature |
| 6 | 250 | High | Reversing | Cooking at Pressure and Temperature |
| 7 | 210 | Low | Conveying | Cooling and Conveying (with venting) |
| 8 | 210 | Low | Pressure Generating | Conveying |

After the slurry exits the extruder, part of the associated polysaccharide/water slurry can be dumped and another part (100 g) can be fed into a Zenith®, type PEP II (Sanford N.C.) and pumped into a SMX style static mixer (Koch-Glitsch, Woodridge, Ill.). The static mixer is used to combine additional additives such as polymers, for example a hydroxyl polymer such as polyvinylalcohol, crosslinking agents, crosslinking facilitators, external plasticizers, such as water, with the associated polysaccharide/water slurry to form an associated polysaccharide-containing composition. The additives are pumped into the static mixer via PREP 100 HPLC pumps (Chrom Tech, Apple Valley Minn.). These pumps provide high pressure, low volume addition capability. The associated polysaccharide-containing composition of the present invention is ready to be processed into a polysaccharide structure.

Processing

"Processing" as used herein means any operation and/or process by which a structure comprising a polysaccharide and/or hydroxyl polymer and an association agent is formed from a polysaccharide and/or hydroxyl polymer-containing composition.

Nonlimiting examples of processing operations include extrusion, molding and/or fiber spinning. Extrusion and molding (either casting or blown), typically produce films, sheets and various profile extrusions. Molding may include injection molding, blown molding and/or compression molding. Fiber spinning may include spun bonding, melt blowing, continuous filament producing and/or tow fiber producing.

Structure

The polysaccharide and/or hydroxyl polymer-containing composition can be subjected to one or more processing operations such that the polysaccharide and/or hydroxyl polymer-containing composition is processed into a structure comprising a polysaccharide and/or hydroxyl polymer and an association agent and optionally, a crosslinking system, according to the present invention.

The crosslinking system via the crosslinking agent crosslinks polysaccharides and/or hydroxyl polymers together to produce the structure of the present invention, with or without being subjected to a curing step. In other words, the crosslinking system in accordance with the present invention acceptably crosslinks the polysaccharides and/or hydroxyl polymers together via the crosslinking agent to form a unitary structure. The crosslinking agent is a "building block" for the structure. Without the crosslinking agent, no structure in accordance with the present invention could be formed.

Structures of the present invention do not include coatings and/or other surface treatments that are applied to a pre-existing form, such as a coating on a fiber, film or foam.

In one example, the structure produced via a processing operation may be cured at a curing temperature of from about 110° C. to about 200° C. and/or from about 120° C. to about 195° C. and/or from about 130° C. to about 185° C. for a time period of from about 0.01 and/or 1 and/or 5 and/or 15 seconds to about 60 minutes and/or from about 20 seconds to about 45 minutes and/or from about 30 seconds to about 30 minutes. Alternative curing methods may include radiation methods such as UV, e-beam, IR and other temperature-raising methods.

Further, the structure may also be cured at room temperature for days, either after curing at above room temperature or instead of curing at above room temperature.

The structure may exhibit an initial total wet tensile, as measured by the Initial Total Wet Tensile Test Method described herein, of at least about 1.18 g/cm (3 g/in) and/or at least about 1.97 g/cm (5 g/in) and/or at least about 5.91 g/cm (15 g/in) and/or at least about 9.84 g/cm (25 g/in) to about 51.18 g/cm (130 g/in) and/or to about 43.31 g/cm (110 g/in) and/or to about 35.43 g/cm (90 g/in) and/or to about 25.53 g/cm (75 g/in) and/or to about 23.62 g/cm (60 g/in) and/or to about 21.65 g/cm (55 g/in) and/or to about 19.69 g/cm (50 g/in).

In one example, a structure of the present invention may comprise from at least about 20% and/or 30% and/or 40% and/or 45% and/or 50% to about 75% and/or 80% and/or 85% and/or 90% and/or 95% and/or 99.5% by weight of the structure of a polysaccharide and/or hydroxyl polymer.

Synthesis of a Structure

Nonlimiting examples of processes for preparing structures comprising a polysaccharide and/or hydroxyl polymer and an association agent in accordance with the present invention follow. For purposes of these nonlimiting examples, the structures will comprise a polysaccharide.

i) Fiber Formation

Figure 2:
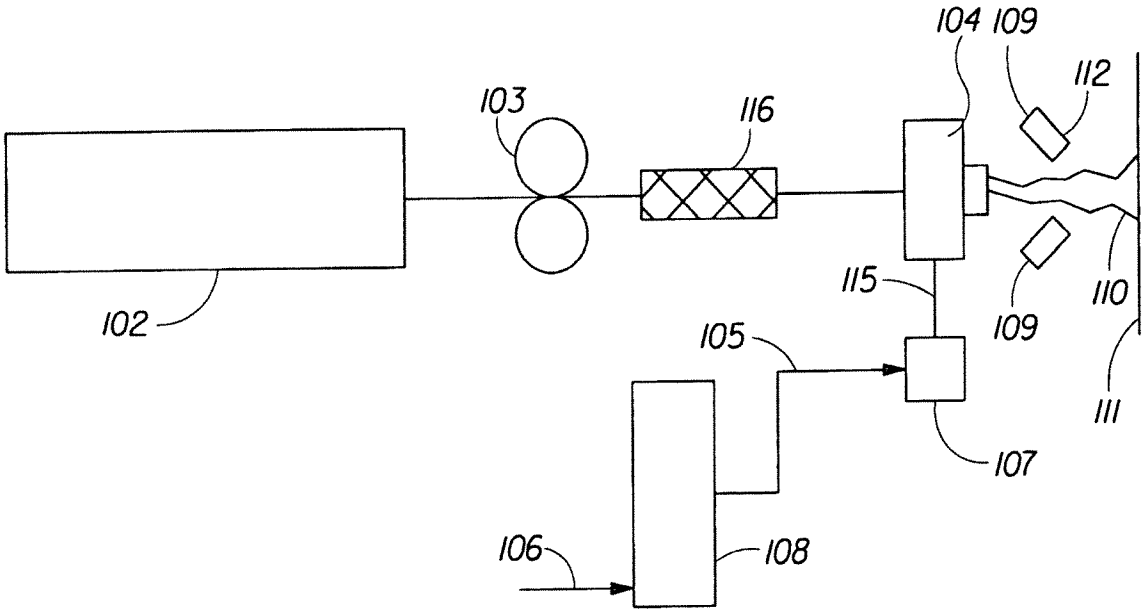
FIG. 2 is a schematic side view of a process for synthesizing a structure in accordance with the present invention.

A polysaccharide-containing composition is prepared according to the Synthesis of a Polysaccharide and/or Hydroxyl Polymer-Containing Composition described above. As shown in FIG. 2, the polysaccharide-containing composition may be processed into a structure comprising a polysaccharide and an association agent. The polysaccharide-containing composition present in an extruder 102 is pumped to a die 104 using pump 103, such as a Zenith®, type PEP II, having a capacity of 0.6 cubic centimeters per revolution (cc/rev), manufactured by Parker Hannifin Corporation, Zenith Pumps division, of Sanford, N.C., USA. The flow of the polysaccharide, such as starch, to die 104 is controlled by adjusting the number of revolutions per minute (rpm) of the pump 103. Pipes connecting the extruder 102, the pump 103, the die 104, and optionally a mixer 116 are electrically heated and thermostatically controlled to 65° C.

Figure 3:
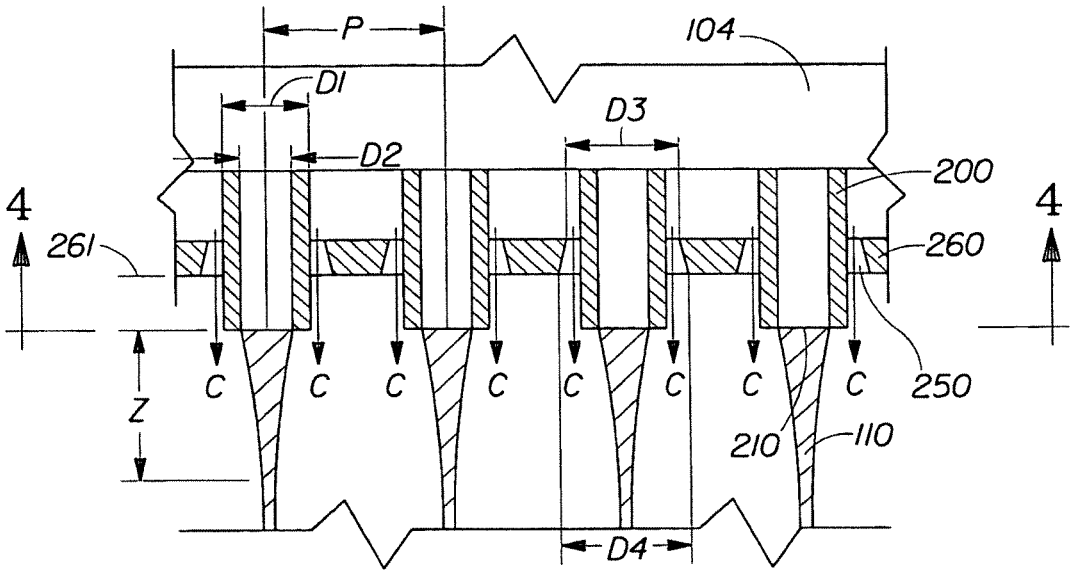
FIG. 3 is a schematic partial side view of the process of the present invention, showing an attenuation zone.
Figure 4:
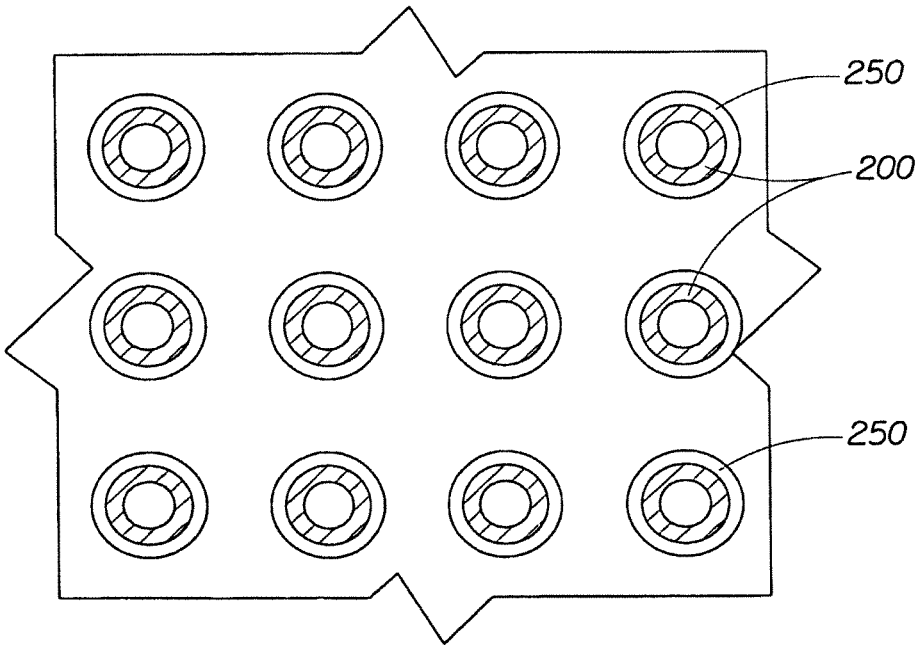
FIG. 4 is a schematic plan view taken along lines 4-4 of FIG. 3 and showing one possible arrangement of a plurality of extrusion nozzles arranged to provide structures of the present invention.

The die 104 has several rows of circular extrusion nozzles 200 spaced from one another at a pitch P (FIG. 3) of about 1.524 millimeters (about 0.060 inches). The nozzles 200 have individual inner diameters D2 of about 0.305 millimeters (about 0.012 inches) and individual outside diameters (D1) of about 0.813 millimeters (about 0.032 inches). Each individual nozzle 200 is encircled by an annular and divergently flared orifice 250 formed in a plate 260 (FIGS. 3 and 4) having a thickness of about 1.9 millimeters (about 0.075 inches). A pattern of a plurality of the divergently flared orifices 250 in the plate 260 correspond to a pattern of extrusion nozzles 200. The orifices 250 have a larger diameter D4 (FIGS. 3 and 4) of about 1.372 millimeters (about 0.054 inches) and a smaller diameter D3 of 1.17 millimeters (about 0.046 inches) for attenuation air. The plate 260 was fixed so that the embryonic fibers 110 being extruded through the nozzles 200 are surrounded and attenuated by generally cylindrical, humidified air streams supplied through the orifices 250. The nozzles can extend to a distance from about 1.5 mm to about 4 mm, and more specifically from about 2 mm to about 3 mm, beyond a surface 261 of the plate 260 (FIG. 3). As shown in FIG. 5, a plurality of boundary-air orifices 300, is formed by plugging nozzles of two outside rows on each side of the plurality of nozzles, as viewed in plane, so that each of the boundary-layer orifice comprised a annular aperture 250 described herein above. Additionally, every other row and every other column of the remaining capillary nozzles are blocked, increasing the spacing between active capillary nozzles As shown in FIG. 2, attenuation air can be provided by heating compressed air from a source 106 by an electrical-resistance heater 108, for example, a heater manufactured by Chromalox, Division of Emerson Electric, of Pittsburgh, Pa., USA. An appropriate quantity of steam 105 at an absolute pressure of from about 240 to about 420 kiloPascals (kPa), controlled by a globe valve (not shown), is added to saturate or nearly saturate the heated air at the conditions in the electrically heated, thermostatically controlled delivery pipe 115. Condensate is removed in an electrically heated, thermostatically controlled, separator 107. The attenuating air has an absolute pressure from about 130 kPa to about 310 kPa, measured in the pipe 115. The fibers 110 being extruded have a moisture content of from about 20% and/or 25% to about 50% and/or 55% by weight. The fibers 110 are dried by a drying air stream 109 having a temperature from about 149° C. (about 300° F.) to about 315° C. (about 600° F.) by an electrical resistance heater (not shown) supplied through drying nozzles 112 and discharged at an angle generally perpendicular relative to the general orientation of the embryonic fibers being extruded. The fibers are dried from about 45% moisture content to about 15% moisture content (i.e., from a consistency of about 55% to a consistency of about 85%) and are collected on a collection device 111, such as, for example, a movable foraminous belt.

The process parameters are as follows.

| Sample | Units | |
|---|---|---|
| Attenuation Air Flow Rate | G/min | 2500 |
| Attenuation Air Temperature | ° C. | 93 |
| Attenuation Steam Flow Rate | G/min | 500 |
| Attenuation Steam Gage Pressure | kPa | 213 |
| Attenuation Gage Pressure in Delivery Pipe | kPa | 26 |
| Attenuation Exit Temperature | ° C. | 71 |
| Solution Pump Speed | Revs/min | 35 |
| Solution Flow | G/min/hole | 0.18 |
| Drying Air Flow Rate | g/min | 10200 |
| Air Duct Type | | Slots |
| Air Duct Dimensions | Mm | 356 × 127 |
| Velocity via Pitot-Static Tube | M/s | 34 |
| Drying Air Temperature at Heater | ° C. | 260 |
| Dry Duct Position from Die | Mm | 80 |
| Drying Duct Angle Relative to Fibers | degrees | 0 |

ii) Foam Formation

The polysaccharide-containing composition for foam formation is prepared similarly as for fiber formation except that the water content will be less, typically from about 10-21% of the polysaccharide weight. With less water to plasticize the polysaccharide, higher temperatures may be needed in extruder zones 5-8 (FIG. 1A), typically from 150-250° C. Also with less water available, it may be necessary to add the crosslinking system, especially the crosslinking agent, with the water in zone 1. In order to avoid premature crosslinking in the extruder, the polysaccharide-containing composition pH should be between 7 and 8, achievable by using a crosslinking facilitator e.g., ammonium salt. A die is placed at the location where the extruded material emerges and is typically held at 160-210° C. Modified high amylose starches (for example greater than 50% and/or greater than 75% and/or greater than 90% by weight of the starch of amylose) granulated to particle sizes ranging from about 400 to about 1500 microns are preferred for this application. It may also be advantageous to add a nucleating agent such as microtalc or alkali metal or alkaline earth metal salt such as sodium sulfate or sodium chloride in an amount of about 1-8% of the starch weight. The foam may be shaped into various forms.

iii) Film Formation

The polysaccharide-containing composition for film formation is prepared similarly as for foam formation except that the added water content is less, typically 3-15% of the polysaccharide weight and a polyol external plasticizer such as glycerol is included at 10-30% of the polysaccharide weight. As with foam formation, zones 5-7 (FIG. 1A) are held at 160-210° C., however, the slit die temperature is lower between 60-120° C. As with foam formation, the crosslinking system, especially the crosslinking agent, may be added along with the water in zone 1 and the polysaccharide-containing composition pH should be between 7-8 achievable by using a crosslinking facilitator e.g., ammonium salt.

Films of the present invention may be utilized for any suitable products known in the art. For example, the films may be used in packaging materials.

Process for Making Structures

The structures of the present invention may be made by any suitable process known to those skilled in the art.

A nonlimiting example of a suitable process for making a structure according to the present invention comprises the step of obtaining a structure comprising a polysaccharide and/or hydroxyl polymer from a polysaccharide and/or hydroxyl polymer-containing composition comprising a polysaccharide and/or hydroxyl polymer.

In still another example of the present invention, a process for making a structure comprising a polysaccharide and/or hydroxyl polymer and an association agent, wherein the process comprises the step of processing a polysaccharide and/or hydroxyl polymer-containing composition comprising a polysaccharide and/or hydroxyl polymer into a structure comprising the polysaccharide and/or hydroxyl polymer and an association agent, is provided.

In even yet another example of the present invention, a process for making a structure comprising a polysaccharide and/or hydroxyl polymer and an association agent, wherein the process comprises the steps of:

a. providing a polysaccharide and/or hydroxyl polymer-containing composition comprising a polysaccharide and/or hydroxyl polymer;

b. associating the polysaccharide and/or hydroxyl polymer to produce an associated polysaccharide and/or associated hydroxyl polymer; and c. processing the polysaccharide and/or hydroxyl polymer-containing composition comprising the associated polysaccharide and/or associated hydroxyl polymer into a structure comprising the polysaccharide and/or hydroxyl polymer, is provided.

In one example, an unsubstituted polysaccharide, specifically one or more hydroxyl moieties present on the unsubstituted polysaccharide, is associated with a moiety for a time sufficient to permit a structure comprising the unsubstituted polysaccharide to be formed from the associated polysaccharide. In other words, without wishing to be bound by theory, the association agent temporarily impacts the properties of the unsubstituted polysaccharide in a manner such that it can be spun and/or otherwise processed into a structure, such as a fiber. Before, during and/or after the structure is formed, the association agent is replaced by a hydroxyl moiety, thus returning the polysaccharide to an unsubstituted form wherein the previously associated oxygen of the hydroxyl moiety is now covalently bonded to a hydrogen.

The associating step may comprise subjecting the polysaccharide and/or hydroxyl polymer to an alkaline pH. For example, the associating step may comprise subjecting the polysaccharide and/or hydroxyl polymer to a pH of greater than 7 and/or at least about 7.5 and/or at least about 8 and/or at least about 8.5. To achieve the alkaline pH, an alkaline agent may be used in the associating step. Nonlimiting examples of suitable alkaline agents may be selected from the group consisting of sodium hydroxide calcium hydroxide, magnesium hydroxide, potassium hydroxide, ammonium hydroxide and mixtures thereof. Further, the associating step may occur at a temperature in the range of from about 70° C. to about 120° C. and/or from about 75° C. to about 100° C.

The associating step may comprise reacting the polysaccharide and/or hydroxyl polymer with an association agent to form an associated polysaccharide and/or associated hydroxyl polymer.

The step of obtaining a fiber from the associated polysaccharide and/or associated hydroxyl polymer may comprise subjecting the associated polysaccharide and/or associated hydroxyl polymer to an acidic pH. For example, the step of obtaining a fiber from an associated polysaccharide and/or associated hydroxyl polymer may comprise subjecting the associated polysaccharide and/or associated hydroxyl polymer to a pH of less than 7 and/or less than about 6 and/or less than about 5 and/or less than about 4.5 and/or less than about 4. To achieve the acidic pH, an acidic agent may be used in the obtaining a fiber step. Nonlimiting examples of suitable acidic agents may be selected from the group consisting of: acetic acid, benzoic acid, citric acid, formic acid, glycolic acid, lactic acid, maleic acid, phthalic acid, phosphoric acid, succinic acid and mixtures thereof and/or their salts, preferably their ammonium salts, such as ammonium glycolate, ammonium citrate, ammonium sulfate, ammonium chloride, and mixtures thereof. Further, the obtaining a fiber step may occur at a temperature in the range of from about 60° C. to about 100° and/or from about 70° C. to about 95° C.

The step of obtaining a structure may comprise spinning the associated polysaccharide and/or associated hydroxyl polymer such that a fiber comprising a polysaccharide and/or hydroxyl polymer is formed. The spinning may be any suitable spinning operation known to those skilled in the art.

The process of the present invention may further comprise a step of collecting a plurality of the fibers to form a web.

Test Methods

All tests described herein including those described under the Definitions section and the following test methods are conducted on samples that have been conditioned in a conditioned room at a temperature of 73° F.±4° F. (about 23° C.±2.2° C.) and a relative humidity of 50%±10% for 24 hours prior to the test. Further, all tests are conducted in such conditioned room. Tested samples and felts should be subjected to 73° F.±4° F. (about 23° C.±2.2° C.) and a relative humidity of 50%±10% for 24 hours prior to capturing images.

A. Apparent Peak Wet Tensile Stress Test Method

The following test has been designed to measure the apparent peak wet tensile stress of a starch fiber during the first minutes of the fiber being moistened—to reflect a consumer's real-life expectations as to the strength properties of the end product, such as, for example, a toilet tissue, during its use.

(A) Equipment:

Sunbeam® ultrasonic humidifier, Model 696-12, manufactured by Sunbeam Household Products Co. of McMinnville, Tenn., USA. The humidifier has an on/off switch and is operated at room temperature. A 27-inch length of 0.625" OD 0.25" ID rubber hose was attached to an output. When operating correctly, the humidifier will output between 0.54 and 0.66 grams of water per minute as a mist.

The water droplet velocity and the water droplet diameter of the mist generated by the humidifier can be measured using photogrammetric techniques. Images can be captured using a Nikon®, Model D1, of Japan, 3-megapixel digital camera equipped with a 37 mm coupling ring, a Nikon® PB-6 bellows, and a Nikon® auto-focus AF Micro Nikkor® 200 mm 1:4 D lens. Each pixel had the dimension of about 3.5 micrometer assuming a square pixel. Images can be taken in shadow mode using a Nano Twin Flash (High-Speed Photo-Systeme, of Wedel, Germany). Any number of commercially available image-processing packages can be used to process the images. The dwell time between the two flashes of this system is set at 5, 10, and 20 microsecond. The distance traveled by water droplets between flashes is used to calculate droplet velocity.

Water droplets were found to be from about 12 microns to about 25 microns in diameter. The velocity of the water droplets at a distance of about (25±5) mm from the outlet of the flexible hose was calculated to be about 27 meters per second (m/sec), ranging from about 15 msec to about 50 msec. Obviously, as the mist stream encountered room air, the velocity of the water droplets slows with increasing distance from the hose exit due to drag forces.

The flexible hose is positioned so that the mist stream totally engulfs the fiber thereby thoroughly wetting the fiber. To ensure that the fiber is not damaged or broken by the mist stream, the distance between the outlet of the flexible hose and the fiber is adjusted until the mist stream stalls at or just past the fiber.

Filament Stretching Rheometer (FSR) with 1-gram Force Transducer, Model 405A, manufactured by Aurora Scientific Inc., of Aurora, Ontario, Canada, equipped with small metal hook. Initial instrument settings are:

| | |
|---|---|
| initial gap = 0.1 cm | strain rate = 0.1 $s^{-1}$ |
| Hencky strain limit = 4 | data points per second = 25 |
| post move time = 0 | |

FSR is based on a design similar to that described in an article titled "A Filament Stretching Device For Measurement Of Extensional Viscosity," published by J. Rheology 37 (6), 1993, pages 1081-1102 (Tirtaatmadja and Sridhar), incorporated herein by reference, with the following modifications:

(a) FSR is oriented so that the two end plates can move in a vertical direction.

(b) FSR comprises two independent ball screw linear actuators, Model PAG001 (manufactured by Industrial Device Corp. of Petaluma, Calif., USA), each actuator driven by a stepper motor (for example, Zeta® 83-135, manufactured by Parker Hannifin Corp., Compumotor Division, Rohnert Park, Calif., USA). One of the motors can be equipped with an encoder (for example, Model E1510000865, manufactured by Dynapar Brand, Danaher Controls of Gurnee, Ill., USA) to track the position of the actuator. The two actuators can be programmed to move equal distances at equal speeds in opposite directions.

(c) The maximal distance between the end plates is approximately 813 mm (about 32 inches).

A wide-bandwidth single-channel signal-conditioning module, Model 5B41-06, manufactured by Analog Devices Co. of Norwood, Mass., USA can be used to condition the signal from the force transducer, Model 405A, manufactured by Aurora Scientific Inc., of Aurora, Ontario, Canada.

Example of Polysaccharide-Containing Fibers and Method for Determining Apparent Peak Wet Tensile Stress Thereof Twenty five grams of a polysaccharide, for example Eclipse G starch (acid thinned dent corn starch of approximate average molecular weight of 3,000,000 g/mol, from A. E. Staley Manufacturing Corporation of Decatur, Ill., USA), 10.00 grams of a hydroxyl polymer, for example 10% Celvol 310 solution in water (Ethenol, homopolymer from Celanese Ltd. Dallas Tex., USA) (4% based on the weight of the starch), 1.00 grams of an alkaline agent, for example 25% Sodium hydroxide solution (1% based on the weight of starch), 0.67 g of a association agent, for example Arquad 12-37W (Trimethyldodecylammonium chloride from Akzo Nobel Chemicals Inc. of Chicago, Ill., USA) (1% based on the weight of the starch), and 50 grams of water are added to a 200 ml beaker. The beaker is disposed in a water bath to boil for approximately one hour while the starch mix is stirred manually to destructure the starch and to evaporate the amount of water until about 25 grams of water remain in the breaker.

Then 1.66 grams of a crosslinking agent, for example Parez® 490 from Lanxess Corp. (formerly Bayer Corp.), Pittsburgh, Pa., USA, (3% urea-glyoxal resin based on the weight of the starch), and 4.00 grams of a crosslinking facilitator, for example 25% Ammonium chloride solution (4% based on the weight of the starch) are added to the beaker and mixed. Then the mixture is cooled to a temperature of about 40° C. A portion of the mixture is transferred to a 10 cubic centimeter (cc) syringe and is extruded therefrom to form a fiber. The fiber is manually elongated so that the fiber has a diameter between about 10 μm and about 100 μm. Then, the fiber is suspended in an ambient air for approximately one minute to allow the fiber to dry and solidify. The fiber is placed on an aluminum pan and is cured in a convection oven for about 10 minutes at a temperature of about 130° C. The cured fiber is then placed in a room having a constant temperature of about 22° C. and a constant relative humidity of about 25% for about 24 hours.

Since the single fibers are fragile, a coupon 90 (FIG. 6) can be used to support the fiber 110. The coupon 90 can be manufactured from an ordinary office copy paper or a similar light material. In an illustrative example of FIG. 6, the coupon 90 comprises a rectangular structure having the overall size of about 20 millimeters by about 8 millimeters, with a rectangle cutout 91 sized about 9 millimeters by about 5 millimeters in the center of the coupon 90. The ends 110*a*, 110*b* of the fiber 110 can be secured to the ends of the coupon 90 with an adhesive tape 95 (such as, for example, a conventional Scotch tape), or otherwise, so that the fiber 110 spans the distance (of about 9 millimeters in the instant example) of the cut-out 91 in the center of the coupon 90, as shown in FIG. 6. For convenience of mounting, the coupon 90 may have a hole 98 in the top portion of the coupon 90, structured to receive a suitable hook mounted on the upper plate of the force transducer. Prior to applying a force to the fiber, the fiber's diameter can be measured with an optical microscope at 3 positions and averaged to obtain the average fiber diameter used in calculations.

The coupon 90 can then be mounted onto a fiber-stretching rheometer (not shown) so that the fiber 110 is substantially parallel to the direction of the load "P" (FIG. 6) to be applied. Side portions of the coupon 90 that are parallel to the fiber 110 can be cut (along lines 92, FIG. 6), so that the fiber 110 is the only element receiving the load.

Then the fiber 110 can be sufficiently moistened. For example, an ultrasonic humidifier (not shown) can be turned on, with a rubber hose positioned about 200 millimeters (about 8 inches) away from the fiber so as to direct the output mist directly at the fiber. The fiber 110 can be exposed to the vapor for about one minute, after which the force load P can be applied to the fiber 110. The fiber 110 continues to be exposed to the vapor during the application of the force load that imparts elongation force to the fiber 110. Care should be taken to ensure that the fiber 110 is continuously within the main stream of the humidifier output as the force is applied to the fiber. When correctly exposed, droplets of water are typically visible on or around the fiber 110. The humidifier, its contents, and the fiber 110 are allowed to equilibrate to an ambient temperature before use.

Using the force load and diameter measurements, the wet tensile stress can be calculated in units of MegaPascals (MPa). The test can be repeated multiple times, for example eight times. The results of wet tensile stress measurements of eight fibers are averaged. The force readings from the force transducer are corrected for the mass of the residual coupon by subtracting the average force transducer signal collected after the fiber had broken from the entire set of force readings. The stress at failure for the fiber can be calculated by taking the maximum force generated on the fiber divided by the cross-sectional area of the fiber based on the optical microscope measurements of the fiber's average fiber diameter measured prior to conducting the test. The actual beginning plate separation (bps) can be dependent on a particular sample tested, but is recorded in order to calculate the actual engineering strain of the sample. In the instant example, the resulting average wet tensile stress of 0.33 MPa, with the standard deviation of 0.29, was obtained.

B. Average Fiber Diameter Test Method

A web comprising fibers of appropriate basis weight (approximately 5 to 20 grams/square meter) is cut into a rectangular shape, approximately 20 mm by 35 mm. The sample is then coated using a SEM sputter coater (EMS Inc, PA, USA) with gold so as to make the fibers relatively opaque. Typical coating thickness is between 50 and 250 nm. The sample is then mounted between two standard microscope slides and compressed together using small binder clips. The sample is imaged using a 10× objective on an Olympus BHS microscope with the microscope light-collimating lens moved as far from the objective lens as possible. Images are captured using a Nikon D1 digital camera. A Glass microscope micrometer is used to calibrate the spatial distances of the images. The approximate resolution of the images is 1 μm/pixel. Images will typically show a distinct bimodal distribution in the intensity histogram corresponding to the fibers and the background. Camera adjustments or different basis weights are used to achieve an acceptable bimodal distribution. Typically 10 images per sample are taken and the image analysis results averaged.

The images are analyzed in a similar manner to that described by B. Pourdeyhimi, R. and R. Dent in "Measuring fiber diameter distribution in nonwovens" (Textile Res. J. 69(4) 233-236, 1999). Digital images are analyzed by computer using the MATLAB (Version. 6.3) and the MATLAB Image Processing Tool Box (Version 3.) The image is first converted into a grayscale. The image is then binarized into black and white pixels using a threshold value that minimizes the intraclass variance of the thresholded black and white pixels. Once the image has been binarized, the image is skeltonized to locate the center of each fiber in the image. The distance transform of the binarized image is also computed. The scalar product of the skeltonized image and the distance map provides an image whose pixel intensity is either zero or the radius of the fiber at that location. Pixels within one radius of the junction between two overlapping fibers are not counted if the distance they represent is smaller than the radius of the junction. The remaining pixels are then used to compute a length-weighted histogram of fiber diameters contained in the image.

C. Initial Total Wet Tensile Test Method

An electronic tensile tester (Thwing-Albert EJA Materials Tester, Thwing-Albert Instrument Co., 10960 Dutton Rd., Philadelphia, Pa., 19154) is used and operated at a crosshead speed of 4.0 inch (about 10.16 cm) per minute and a gauge length of 1.0 inch (about 2.54 cm), using a strip of a structure of 1 inch wide and a length greater than 3 inches long. The two ends of the strip are placed in the upper jaws of the machine, and the center of the strip is placed around a stainless steel peg (0.5 cm in diameter). After verifying that the strip is bent evenly around the steel peg, the strip is soaked in distilled water at about 20° C. for a soak time of 5 seconds before initiating cross-head movement. The initial result of the test is an array of data in the form load (grams force) versus cross-head displacement (centimeters from starting point).

The sample is tested in two orientations, referred to here as MD (machine direction, i.e., in the same direction as the continuously wound reel and forming fabric) and CD (cross-machine direction, i.e., 90° from MD). The MD and CD wet tensile strengths are determined using the above equipment and calculations in the following manner:

$$\text{Initial Total Wet Tensile}=\text{ITWT}(g_f/\text{inch})=\text{Peak Load}_{MD}(g_f)/2(\text{inch}_{width})+\text{Peak Load}_{CD}(g_f)/2(\text{inch}_{width})$$

The Initial Total Wet Tensile value is then normalized for the basis weight of the strip from which it was tested. The normalized basis weight used is 36 g/m$^2$, and is calculated as follows:

$$\text{Normalized } \{ITWT\} = \{ITWT\} * 36(g/m^2)/\text{Basis Weight of Strip}(g/m^2)$$

If the initial total wet tensile of a structure comprising a crosslinking system of the present invention is at least 1.18 g/cm (30 g/in) and/or at least 1.57 g/cm (4 g/in) and/or at least 1.97 g/cm (5 g/in), then the crosslinking system is acceptable and is within the scope of the present invention. The initial total wet tensile may be less than or equal to about 23.62 g/cm (60 g/in) and/or less than or equal to about 21.65 g/cm (55 g/in) and/or less than or equal to about 19.69 g/cm (50 g/in).

D. Presence of Association Agent Test Method

Whether an association agent is present in a structure, such as a fiber, and/or in a fibrous structure and/or in a sanitary tissue product can be determined utilizing standard test methods, namely HPLC-mass spectroscopy or GC-mass spectroscopy or capillary electrophoresis-mass spectroscopy, examples of such methods are described in Vogt, Carla; Heinig, Katja. Trace analysis of surfactants using chromatographic and electrophoretic techniques. Fresenius' Journal of Analytical Chemistry (1999), 363(7), 612-618. CODEN: FJACES ISSN:0937-0633. CAN 130:283696 AN 1999:255335 CAPLUS All documents cited in the Detailed Description of the Invention are, in relevant part, incorporated herein by reference; the citation of any document is not to be construed as an admission that it is prior art with respect to the present invention. Terms or phrases defined herein are controlling even if such terms or phrases are defined differently in the incorporated herein by reference documents.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A non-naturally occurring starch fiber comprising an unsubstituted starch and an alkyl amine, wherein the starch fiber has an average fiber diameter of less than about 50 μm and wherein the starch fiber comprises at least 50% to about 99.5% by weight of starch within the fiber and at least about 0.01% to about 50% by weight of the alkyl amine within the fiber.

2. The starch fiber according to claim 1 wherein the starch fiber exhibits an apparent peak wet tensile stress greater than 0.2 MPa.

3. The starch fiber according to claim 1 wherein the unsubstituted starch has a weight average molecular weight of at least 10,000 g/mol.

4. The starch fiber according to claim 1 wherein the starch fiber further comprises a polysaccharide selected from the group consisting of: chitosan, gums, arabinans, galactans and mixtures thereof.

5. The starch fiber according to claim 1 wherein the starch fiber further comprises a hydroxyl polymer selected from the group consisting of: polyvinyl alcohol, polyvinyl alcohol copolymers, polyvinyl alcohol derivatives and mixtures thereof.

6. The starch fiber according to claim 1 wherein the starch fiber further comprises a polymer selected from the group consisting of: petroleum-derived polymers, polyvinylamines and mixtures thereof.

7. The starch fiber according to claim 1 wherein the starch fiber exhibits a pH of less than 7.

8. The starch fiber according to claim 1 wherein the starch fiber as a whole exhibits no melting point.

9. A web comprising a starch fiber according to claim 1, wherein the web exhibits an initial total wet tensile greater than about 10 g/in.

10. A single- or multi-ply sanitary tissue product comprising a web according to claim 9.

* * * * *